US012523129B2

(12) United States Patent
Dubost et al.

(10) Patent No.: US 12,523,129 B2
(45) Date of Patent: Jan. 13, 2026

(54) SYSTEMS AND METHODS FOR PRODUCING HYDROCARBONS DOWNHOLE AND PERFORMING DEEP TRANSIENT TESTING USING COILED TUBING

(71) Applicant: Schlumberger Technology Corporation, Sugar Land, TX (US)

(72) Inventors: Francois Xavier Dubost, Montpellier (FR); Romulo Diaz Vega, Houston, TX (US); Ashers Partouche, Katy, TX (US); Pierre Ramondenc, Puteaux (FR); Janessa Carrasco Contreras, Bogota (CO); Diego Fernandez Castano, Kellyville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/744,067

(22) Filed: Jun. 14, 2024

(65) Prior Publication Data

US 2024/0418062 A1 Dec. 19, 2024

Related U.S. Application Data

(60) Provisional application No. 63/508,119, filed on Jun. 14, 2023.

(51) Int. Cl.

| | |
|---|---|
| ***E21B 43/12*** | (2006.01) |
| ***E21B 43/11*** | (2006.01) |
| ***E21B 49/08*** | (2006.01) |

(52) U.S. Cl.
CPC ..... *E21B 43/12* (2013.01); *E21B 43/11* (2013.01); *E21B 49/087* (2013.01); *E21B 2200/05* (2020.05)

(58) Field of Classification Search
CPC ..... E21B 43/12; E21B 43/11; E21B 49/087; E21B 2200/05
See application file for complete search history.

(56) References Cited

U.S. PATENT DOCUMENTS 7,874,366 B2 * 1/2011 Allcorn ..... E21B 41/0078 166/311
7,905,291 B2 * 3/2011 Kotsonis ..... E21B 37/00 166/311

(Continued)

FOREIGN PATENT DOCUMENTS

WO 2023064325 A1 4/2023

OTHER PUBLICATIONS

Search Report and Written Opinion of International Patent Application No. PCT/US2024/034023 Dated Sep. 30, 2024, 11 Pages.

*Primary Examiner* — Yong-Suk (Philip) Ro
(74) *Attorney, Agent, or Firm* — Jeffrey D. Frantz

(57) ABSTRACT

Systems and methods presented herein facilitate coiled tubing operations, and generally relate to conveying, via coiled tubing, a downhole well tool into a wellbore extending through a hydrocarbon-bearing reservoir, and performing a plurality of downhole well operations (production operations, perforation operations, testing operations, clean out operations, and so forth) using the downhole well tool. In general, the plurality of downhole well operations may be performed using the downhole well tool while maintaining full well control and without removing the downhole well tool from the wellbore.

20 Claims, 7 Drawing Sheets

(56) References Cited

U.S. PATENT DOCUMENTS

| | | | | |
|---|---|---|---|---|
| 7,980,306 | B2 * | 7/2011 | Lovell | E21B 49/008 166/250.07 |
| 8,763,696 | B2 | 7/2014 | Bedouet | |
| 10,087,752 | B2 | 10/2018 | Bedouet | |
| 10,097,752 | B2 | 10/2018 | Furuta | |
| 10,107,096 | B2 | 10/2018 | Bedouet | |
| 10,370,932 | B2 | 8/2019 | Rouchon | |
| 2012/0145402 | A1 * | 6/2012 | Hilliard | E21B 34/06 166/312 |
| 2014/0182849 | A1 | 7/2014 | Kumbhar | |
| 2017/0321547 | A1 | 11/2017 | Enkababian | |
| 2021/0131225 | A1 | 5/2021 | Churchill | |
| 2021/0246782 | A1 | 8/2021 | Eng | |
| 2022/0220823 | A1 | 7/2022 | Al-Mumen | |

* cited by examiner

SYSTEMS AND METHODS FOR PRODUCING HYDROCARBONS DOWNHOLE AND PERFORMING DEEP TRANSIENT TESTING USING COILED TUBING

CROSS REFERENCE PARAGRAPH

This application claims the benefit of U.S. Provisional Application No. 63/508,119, entitled "SYSTEMS AND METHODS FOR PRODUCING HYDROCARBONS DOWNHOLE AND PERFORMING DEEP TRANSIENT TESTING USING COILED TUBING" filed Jun. 14, 2023, the disclosure of which is hereby incorporated herein by reference.

BACKGROUND

The present disclosure generally relates to systems and methods for conducting a deep transient test on a wireline system, including flowing hydrocarbons in a wellbore, and circulating the hydrocarbons to the surface safely under well control conditions using coiled tubing. This testing may be repeated for multiple zones with a downhole well tool while it is conveyed on the coiled tubing and produced hydrocarbons are systematically cleaned as they are produced, due at least in part to the downhole system attached to the coiled tubing head.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

SUMMARY

A summary of certain embodiments described herein is set forth below. It should be understood that these aspects are presented merely to provide the reader with a brief summary of these certain embodiments and that these aspects are not intended to limit the scope of this disclosure.

In many dynamic reservoir evaluation operations, a formation testing system is conveyed on wireline to test reservoirs and produce native fluids to sample such fluids. Some systems involve performing deep transient tests on wireline by conveying the wireline formation tester on drill pipe and circulating hydrocarbons with drilling fluids continuously to provide well control while testing. U.S. Pat. Nos. 8,763,696, 10,087,752, 10,107,096, and 10,370,932 are examples of existing systems.

As described in greater detail herein, the systems and methods of the present disclosure combine conveying a formation testing tool on coiled tubing for the purpose of deep transient testing with continuous circulation via the coiled tubing. For example, the embodiments described herein generally include systems and methods for producing hydrocarbons during deep transient testing of a well, and cleaning the well, using coiled tubing. For example, the embodiments described herein enable the performance of deep transient testing and sampling, conveyed by coiled tubing in an open hole or cased hole, by producing a relatively high amount of hydrocarbons in a well and circulating the hydrocarbons out of the well using coiled tubing cleanout capability, while maintaining full well control throughout the operations.

The downhole well tools described herein are uniquely configured to enable them to perform the techniques herein while being conveyed downhole via coiled tubing. As described in greater detail herein, the downhole well tools facilitate connection to the reservoir to enable the flow of reservoir hydrocarbons into the downhole well tools to capture samples and perform downhole fluid analysis (e.g., with the electric cable connected and complete real-time data streaming) to enable operators to know the type and composition of the hydrocarbons. In addition, the downhole well tools enable testing layers of subterranean formation to evaluate layer productivity. For example, in certain embodiments, the downhole well tools may be equipped with pressure, temperature, flow rate sensors, among other testing features. Deep transient testing may be performed by the downhole well tools with relatively long flow times as the hydrocarbons are lifted from the downhole well tool to a circulating point where, due at least in part to the coiled tubing, the hydrocarbons may be circulated out and the well may be cleaned as the testing proceeds. Usually, deep transient tests are conducted on drill pipe with a drilling rig. The embodiments described herein enable the ability to operate rigless, to convey a downhole well tool via coiled tubing and circulate hydrocarbons from the formation to the surface.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
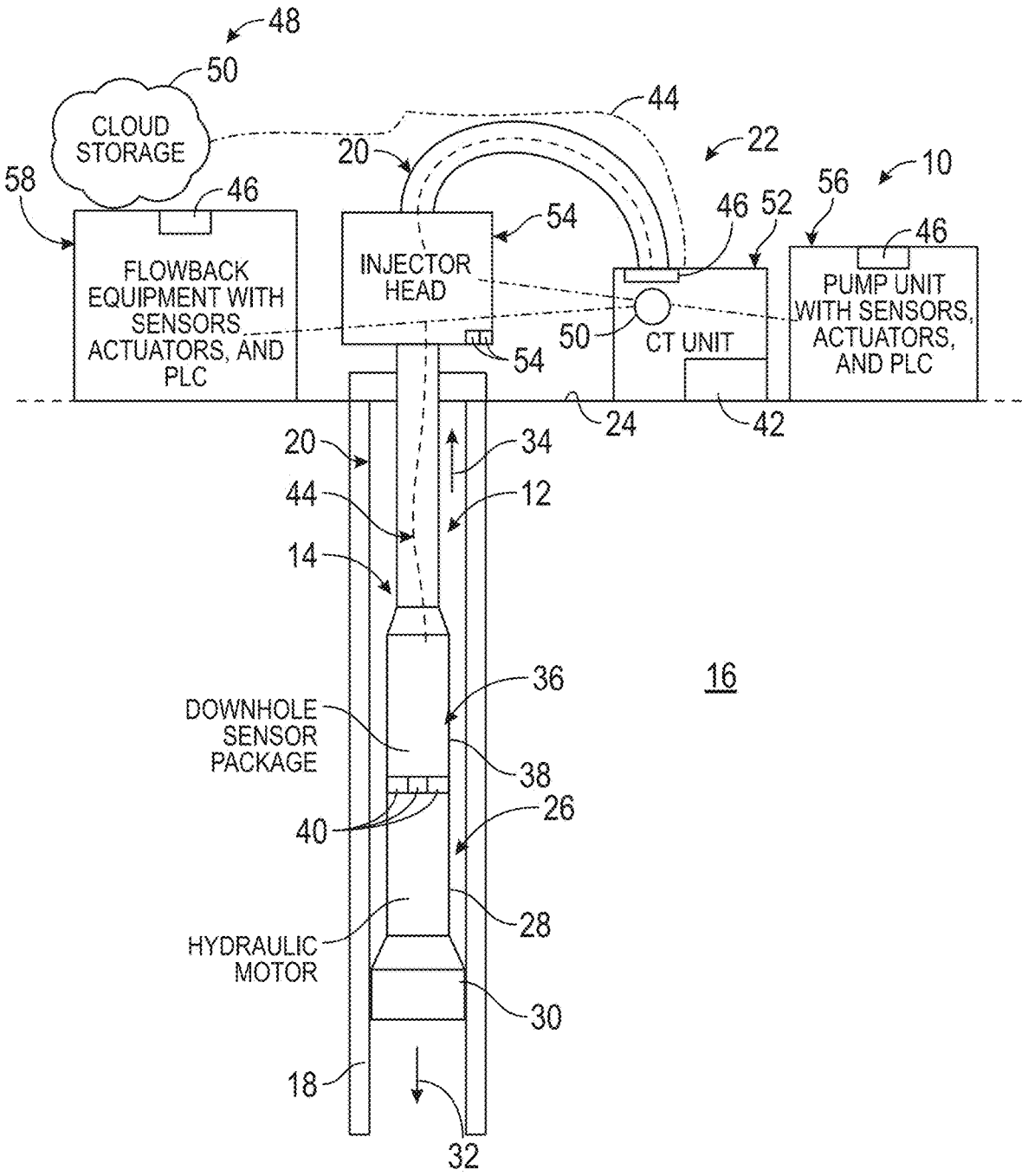
FIG. 1 is a schematic illustration of a well system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth being the lowest (e.g., downhole or lower) point, whether the well (e.g., wellbore, borehole) is vertical, horizontal or slanted relative to the surface.

As used herein, a fracture shall be understood as one or more cracks or surfaces of breakage within rock. Fractures can enhance permeability of rocks greatly by connecting pores together and, for that reason, fractures can be induced mechanically in some reservoirs in order to boost hydrocarbon flow. Certain fractures may also be referred to as natural fractures to distinguish them from fractures induced as part of a reservoir stimulation. Fractures can also be grouped into fracture clusters (or "perf clusters") where the fractures of a given fracture cluster (perf cluster) connect to the wellbore through a single perforated zone. As used herein, the term "fracturing" refers to the process and methods of breaking down a geological formation and creating a fracture (i.e., the rock formation around a well bore) by pumping fluid at relatively high pressures (e.g., pressure above the determined closure pressure of the formation) in order to increase production rates from a hydrocarbon reservoir.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a processing system (i.e., solely by the processing system, without human intervention).

As discussed above, the embodiments described herein generally include systems and methods for producing hydrocarbons during deep transient testing of a well, and cleaning the well, using coiled tubing. For example, the embodiments described herein enable the performance of deep transient testing and sampling, conveyed by coiled tubing in an open hole or cased hole, by producing a relatively high amount of hydrocarbons in a well and circulating the hydrocarbons out of the well using coiled tubing cleanout capability, while maintaining full well control throughout the operations.

As described above, the downhole well tools described herein are uniquely configured to enable them to perform the techniques herein while being conveyed downhole via coiled tubing. As described in greater detail herein, the downhole well tools facilitate connection to the reservoir to enable the flow of reservoir hydrocarbons into the downhole well tools to capture samples and perform downhole fluid analysis to enable operators to know the type and composition of the hydrocarbons. In addition, the downhole well tools enable testing layers of subterranean formation to evaluate layer productivity. For example, in certain embodiments, the downhole well tools may be equipped with pressure, temperature, flow rate sensors, among other testing features. Deep transient testing may be performed by the downhole well tools with relatively long flow times as the hydrocarbons are lifted from the downhole well tool to a circulating point where, due at least in part to the coiled tubing, the hydrocarbons may be circulated out and the well may be cleaned as the testing proceeds. Usually, deep transient tests are conducted on drill pipe with a drilling rig. The embodiments described herein enable the ability to operate rigless, to convey a downhole well tool via coiled tubing and circulate hydrocarbons from the formation to the surface.

With the foregoing in mind, FIG. 1 is a schematic illustration of an example well system 10 utilizing a coiled tubing string 12 that is run into a wellbore 14 that traverses a hydrocarbon-bearing reservoir 16. While certain elements of the well system 10 are illustrated in FIG. 1, other elements of the well (e.g., blow-out preventers, wellhead "tree", etc.) have been omitted for clarity of illustration. In certain embodiments, the well system 10 includes an interconnection of pipes, including vertical and/or horizontal casings 18, coiled tubing 20, and so forth, that connect to a surface facility 22 at the surface 24 of the well system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the coiled tubing 20. As illustrated in FIG. 1, in certain embodiments, the BHA 26 may include a downhole motor 28 that operates to rotate a drill bit 30 (e.g., during drilling operations) or other downhole well tool. In certain embodiments, the downhole motor 28 may be driven by hydraulic forces carried in fluid supplied from the surface 24 of the well system 10. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drill bit 30 through an interior of the coiled tubing 20 to aid in the drilling process and carry cuttings and possibly other fluid and solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the well system 10. Under certain conditions, fracturing fluid and possibly hydrocarbons (oil and/or gas), proppants and possibly rock fragments may flow from the fractured reservoir 16 through perforations in a newly opened interval and back to the surface 24 of the well system 10 as part of the return fluid 34. In certain embodiments, the BHA 26 may be supplemented behind the rotary drill by an isolation device such as, for example, an inflatable packer that may be activated to isolate the zone below or above it, and enable local pressure tests.

As such, in certain embodiments, the well system 10 may include a downhole well tool 36 that is moved along the wellbore 14 via the coiled tubing 20. In certain embodiments, the downhole well tool 36 may include a variety of drilling/cutting tools coupled with the coiled tubing 20 to provide a coiled tubing string 12. In the illustrated embodiment, the downhole well tool 36 includes a drill bit 30, which may be powered by a motor 28 (e.g., a positive displacement motor (PDM), or other hydraulic motor) of a BHA 26. In certain embodiments, the wellbore 14 may be an open wellbore or a cased wellbore defined by a casing 18. In addition, in certain embodiments, the wellbore 14 may be vertical or horizontal or inclined. It should be noted the downhole well tool 36 may be part of various types of BHAs 26 coupled to the coiled tubing 20.

As also illustrated in FIG. 1, in certain embodiments, the well system 10 may include a downhole sensor package 38 having a plurality of downhole sensors 40. In certain embodiments, the sensor package 38 may be mounted along the coiled tubing string 12, although certain downhole sensors 40 may be positioned at other downhole locations in other embodiments. In certain embodiments, data from the downhole sensors 40 may be relayed uphole to a surface processing system 42 (e.g., a computer-based processing system) disposed at the surface 24 and/or other suitable location of the well system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, hybrid electro-optical line, or other suitable control line for transmitting real-time telemetry data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in memory locations 48. By way of example, historical data and other useful data may be stored in a memory location 48 such as cloud storage 50.

As illustrated, in certain embodiments, the coiled tubing 20 may deployed by a coiled tubing unit 52 and delivered downhole via an injector head 54. In certain embodiments, the injector head 54 may be controlled to slack off or pick up on the coiled tubing 20 so as to control the tubing string weight and, thus, the weight on bit (WOB) acting on the bit of the drill bit 30 (or other downhole well tool 36). In certain embodiments, the downhole well tool 36 may be moved along the wellbore 14 via the coiled tubing 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, the data may be used to fully or partially automate the downhole operation, to optimize the downhole operation, and/or to provide more accurate predictions regarding components or aspects of the downhole operation.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28 and, thus, the drill bit 30. In certain embodiments, the return fluid 34 is returned uphole, and this flow back of return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the pump unit 56 and the flowback equipment 58 may include advanced sensors, actuators, and local controllers, such as PLCs, which may cooperate together to provide sensor data to, receive control signals from, and generate local control signals based on communications with, respectively, the surface processing system 42. In certain embodiments, the sensors may include flow rate, pressure, and fluid rheology sensors, among other types of sensors. In addition, the actuators may include actuators for pump and choke control of the pump unit 56 and the flowback equipment 58, respectively, among other types of actuators.

Figure 2:
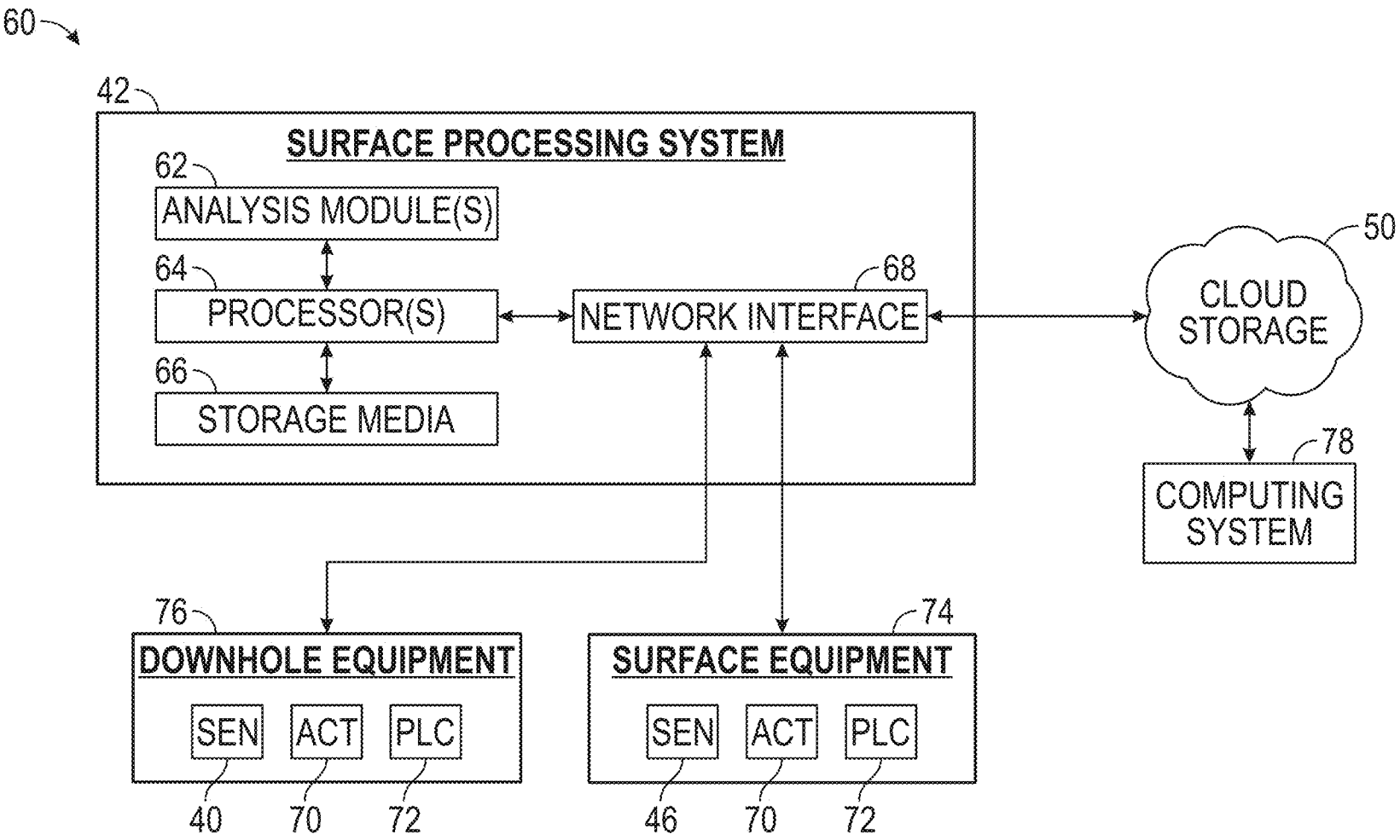
FIG. 2 illustrates a well control system that may include a surface processing system to control the well system described herein, in accordance with embodiments of the present disclosure.

FIG. 2 illustrates a well control system 60 that may include the surface processing system 42 to control the well system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, an analysis module 62 executes on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the various downhole sensors 40 and surface sensors 46 described herein, as well as communicate with the actuators 70 and/or PLCs 72 of the surface equipment 74 (e.g., the coiled tubing unit 52, the pump unit 56, the flowback equipment 58, and so forth, illustrated in FIG. 1) and of the downhole equipment 76 (e.g., the BHA 26, the downhole motor 28, the drill bit 30, the downhole well tool 36, and so forth, illustrated in FIG. 1) for the purpose of controlling operation of the well system 10, as described in greater detail herein. In certain embodiments, the network interface 68 may also facilitate the surface processing system 42 to communicate data to cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

Figure 3:
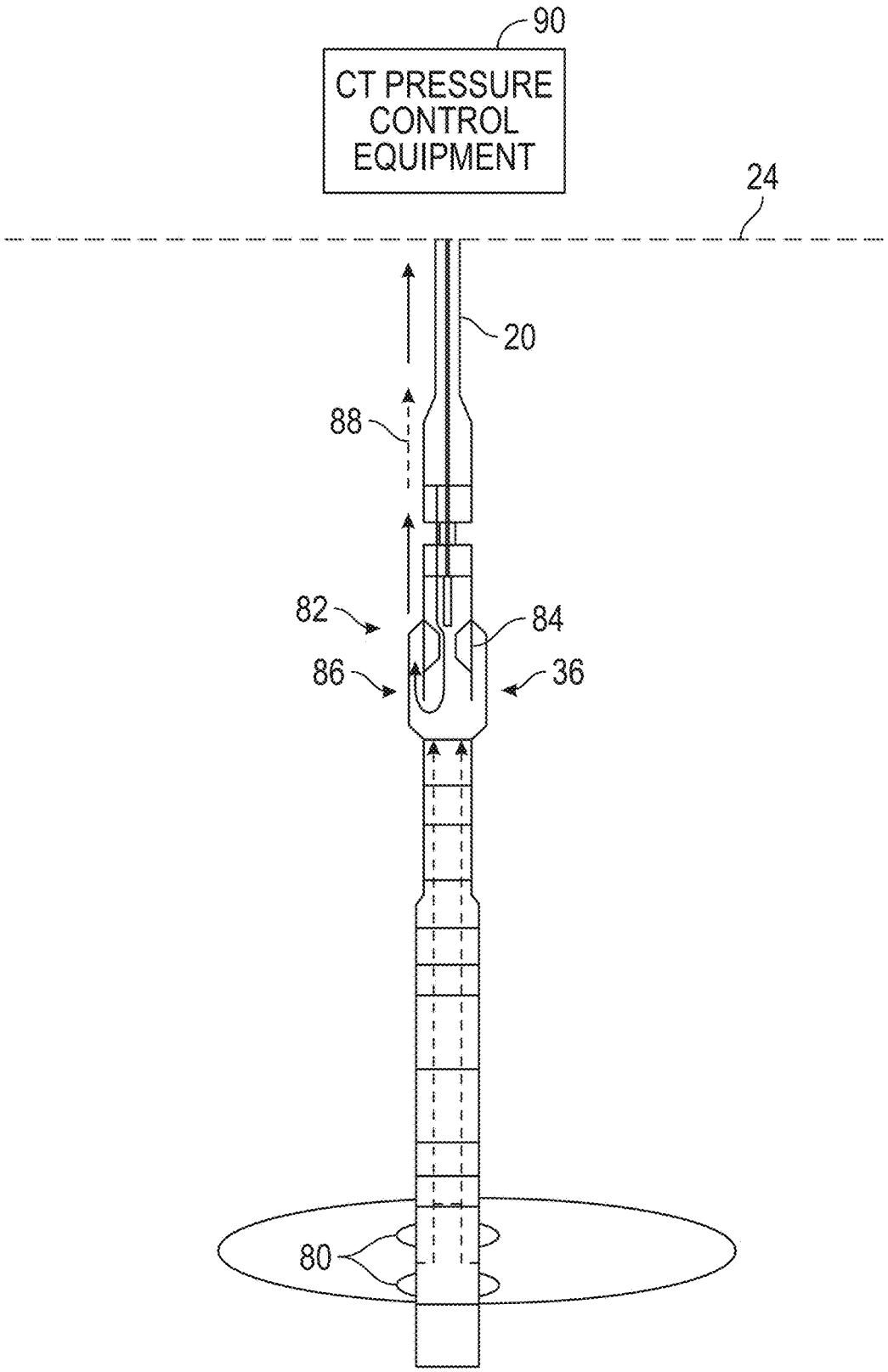
FIG. 3 illustrates a downhole well tool that may be lowered to a target depth within a wellbore (e.g., conveyed by coiled tubing) to perform downhole well operations on a hydrocarbon-bearing reservoir through which the wellbore extends, in accordance with embodiments of the present disclosure.

As described in greater detail herein, the embodiments described herein provide systems and methods for producing hydrocarbons during deep transient testing of a well (e.g., as performed by the downhole well tool 36 illustrated in FIG. 1), and cleaning the well, using coiled tubing 20. FIG. 3 illustrates a downhole well tool 36 that may be lowered to a target depth within a wellbore 14 (e.g., conveyed by coiled tubing 20) to perform downhole well operations on a hydrocarbon-bearing reservoir 16 through which the wellbore 14 extends. Once the downhole well tool 36 is lowered to the target depth, a production test may be conducted by the downhole well tool 36 after inflating dual packers 80 at the bottom of the downhole well tool 36 and flowing the native fluid in the downhole well tool 36 and the produced fluid is conveyed up the toolstring to the coiled tubing circulation head 82 (or, right below, at the level of a flow exit port 84) where the drilling or completion fluid is mixed with the hydrocarbons (e.g., in a mud mixing chamber 86 of the coiled tubing circulation head 82).

In certain embodiments, nitrogen or a cleanout chemical, or a combination thereof, may be circulated down the coiled tubing 20 and through a flow exit port 84 located at the coiled tubing circulation head 82 to initiate return fluid 88 sent to the surface 24. Throughout the operation, well control may be maintained via the coiled tubing pressure control equipment 90 (e.g., the pump unit 56 illustrated in FIG. 1), and the hydrocarbon/drilling or completion fluid mix may be circulated out to the flowback equipment 58 illustrated in FIG. 1.

In certain embodiments, the operation may happen under four different scenarios, and the fluid present in the wellbore 14 (e.g., either drilling or completion fluid) may vary depending on which scenario is considered:

1. Open hole with active circulation: the well remains open hole and the downhole well tool 36 may be conveyed using coiled tubing 20. In this scenario, active circulation may be provided by mobilization of the drilling fluid with produced hydrocarbons.
2. Open hole without active circulation during production: the well remains open hole and the downhole well tool 36 may be conveyed using coiled tubing 20. Deep transient testing of the well may be performed during production of hydrocarbons into the well via an exit port 84 in the toolstring. In addition, the well may be controlled at the surface with the coiled tubing pressure control equipment 90 (e.g., the pump unit 56 illustrated in FIG. 1), and overbalance may be provided by the mud column. Once the testing is completed, the downhole well tool 36 may be lowered so that the flow exit port 84 at the level of the coiled tubing circulation head 82 goes below the zone of produced hydrocarbons, and then well may be cleaned with circulation of cleanout fluid through the coiled tubing 20, and then returned to the surface 24 in the wellbore annulus formed between the coiled tubing 20 and the wellbore 14. As used herein, the term "cleanout fluid" may include any mix of liquids (of different types and rheology) and gases (such as nitrogen).

3. Cased hole without active circulation: the well is cased. Fluid in the wellbore 14 may be either drilling fluid or completion fluid. In certain embodiments, wireline may be run to perforate different intervals with the coiled tubing pressure control equipment 90. Then, the downhole well tool 36 may be lowered to conduct the testing. Then, the wireline may be removed and the coiled tubing 20 rigged up and lowered to the bottom of the well to clean the hydrocarbons produced.
4. Cased hole with active circulation: the well is cased. Fluid in the wellbore 14 may be either drilling fluid or completion fluid. In certain embodiments, wireline may be run to perforate different intervals with the coiled tubing pressure control equipment 90. Then, the downhole well tool 36 may be lowered with the coiled tubing equipment, and tests may be conducted by straddling open perforations and with active circulation using the coiled tubing 20.

The embodiments described herein are different than conventional methods by enabling all activities (e.g., production, perforating, testing, cleanout, and so forth) with only one conveyance means, while maintaining full well control, no matter the status of the well. Doing so reduces the equipment and environmental footprint, while providing the capability to pump fluid to ease circulation/cleanout at any point during the operation. All the design tools are available to choose between scenarios 3 and 4 above, and when everything is run on coiled tubing 20, the best approach may be determined based on wellbore conditions, geometry, wellbore fluid, and available equipment. In certain situations, the workflow that is used may be determined by first starting from the cleanout design (e.g., using the coiled tubing 20) to extract the correct specifications of the coiled tubing (or other cable) equipment and the impact on the testing and/or perforating workflows.

A few example will now be presented to further illustrate how the embodiments described herein may be implemented. For example, in a cased hole, a workflow may be implemented that includes the following steps:

1. Run cement bond logs and ensure good cement integrity behind the pipe and bonding to the formation 16.
2. Run scraper run to clean up the inner casing 18.
3. Run wireline perforating guns and perforate reservoirs to be tested. In certain situations, the perforations could be deep penetrating perforations. Such perforations should be performed in overbalanced conditions using wireline pressure control equipment.
4. Pull out of hole (POOH) the perforating guns and lay down the perforating equipment and pressure control equipment (PCE) while the well is closed and overbalanced.
5. Rig up and run the downhole well tool 36 (and associated circulating sub, described below) on the coiled tubing 20 using coiled tubing pressure control equipment 90.

Another alternative workflow that may be implemented includes the following steps:

1. Run cement bond logs and ensure good cement integrity behind the pipe and bonding to the formation 16.
2. Run scraper run to clean up the inner casing 18.
3. Run coiled tubing perforating guns and perforate reservoirs to be tested using coiled tubing pressure control equipment 90. In certain situations, the perforations could be deep penetrating perforations.
4. Pull out of hole (POOH) the perforating guns and lay down the perforating equipment and pressure control equipment (PCE).
5. Rig up and run the downhole well tool 36 (and associated circulating sub, described below) on the coiled tubing 20 using coiled tubing pressure control equipment 90.

It should be noted that one of the advantages of perforating with coiled tubing 20 is that it would not necessarily need to be overbalanced, but rather may be underbalanced, which could help clean the perforation tunnels and/or limit potential damage. It should also be noted that, in general, the downhole well tool 36 cannot be run with the perforating equipment insofar as the downhole well tool 36 could potentially be damaged.

Figure 4:
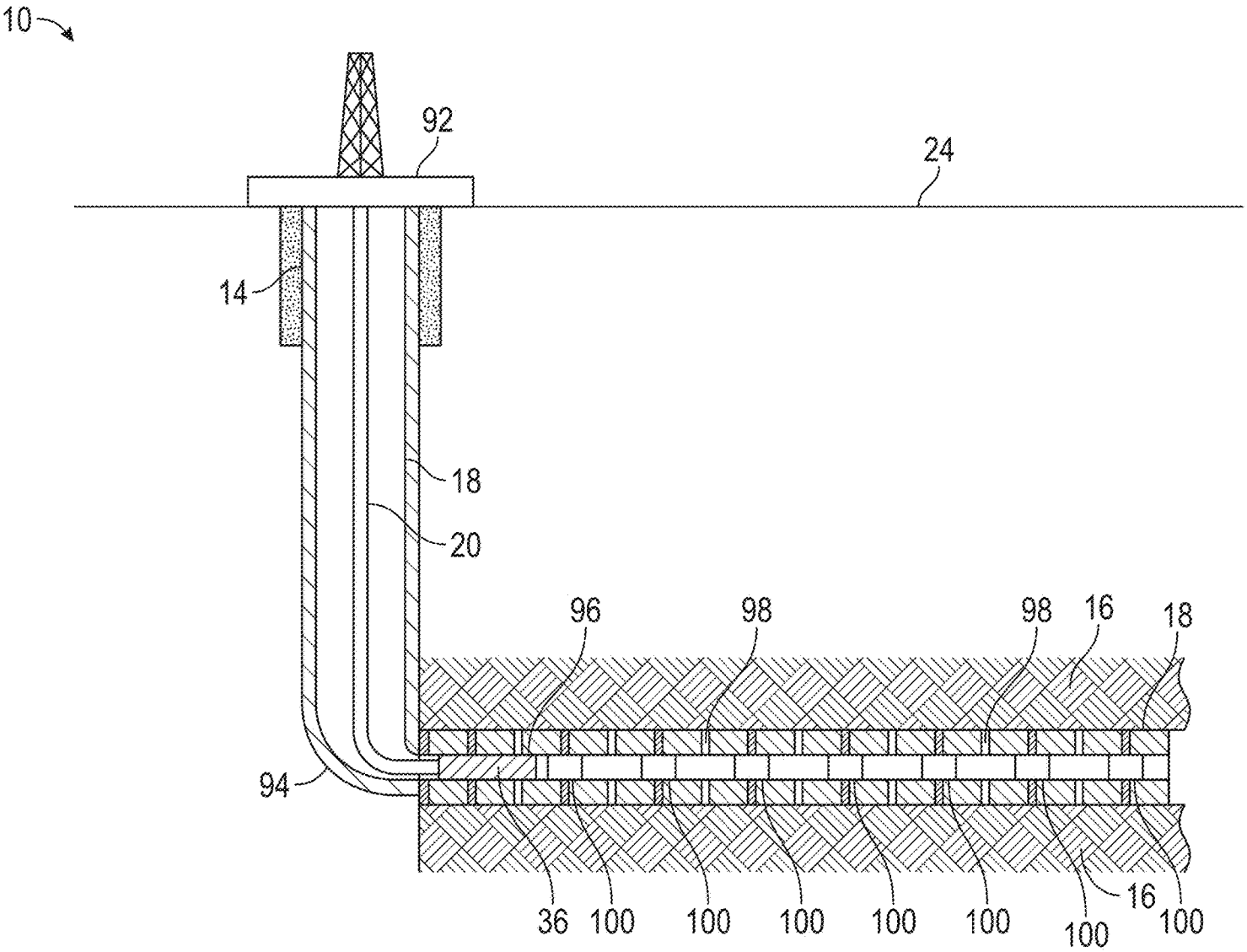
FIG. 4 illustrates the downhole well tool being conveyed by coiled tubing, in accordance with embodiments of the present disclosure.

FIG. 4 illustrates the downhole well tool 36 being conveyed by coiled tubing 20. As illustrated, in certain embodiments, a platform and derrick 92 may be positioned over a wellbore 14 that traverses a hydrocarbon-bearing reservoir 16 by rotary drilling. While certain elements of the well system 10 are illustrated in FIG. 4, other elements of the well (e.g., the surface equipment illustrated in FIG. 1) have been omitted for clarity of illustration. In certain embodiments, the well system 10 includes an interconnection of pipes, including vertical and horizontal casing 18, coiled tubing 20, a transition 94, and a production liner 96 that connect to a surface facility 22 (as illustrated in FIG. 1) at the surface 26 of the well system 10. In certain embodiments, the coiled tubing 20 extends inside the casing 18 and terminates at a tubing head 54 (not shown) at or near the surface 26. In addition, in certain embodiments, the casing 18 contacts the wellbore 14 and terminates at a casing head (not shown) at or near the surface 26. In certain embodiments, the production liner 96 and/or the casing 18 have aligned radial openings termed "perforation zones" 98 that allow fluid communication between the production liner 96 and the hydraulically fractured hydrocarbon-bearing reservoir or formation 16. As illustrated in FIG. 4, in certain embodiments, several perforation zones 98 may be tested, conveying the downhole well tool 36 with coiled tubing 20 and straddling different sets of perforations with various downhole components 100 such as packers, expanding slips, seal members, and so forth.

Figure 5:
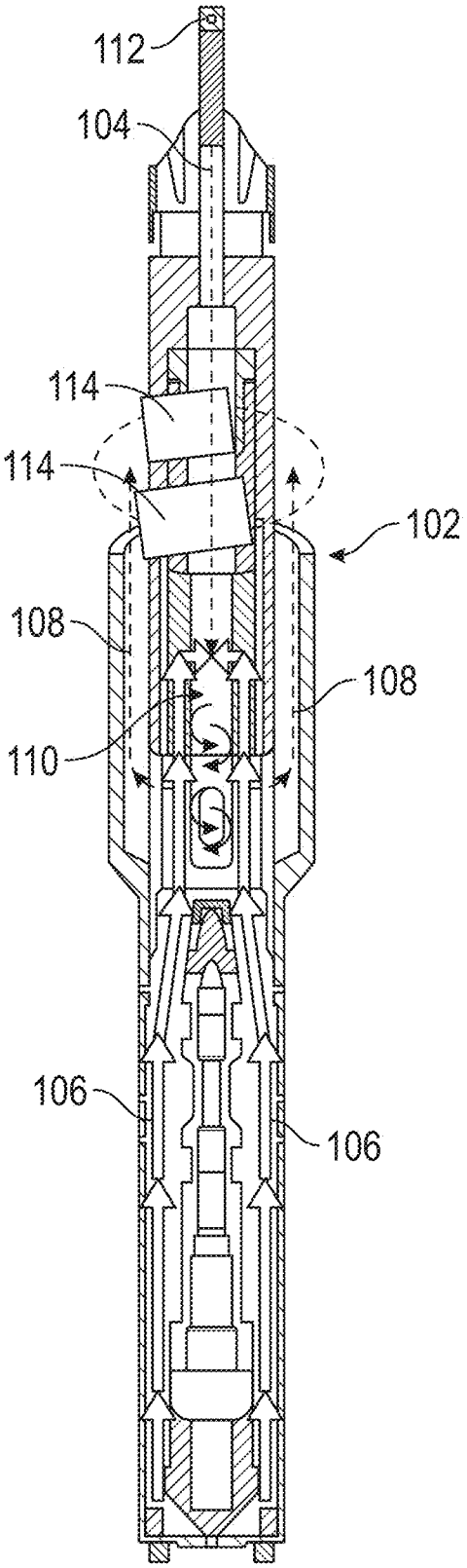
FIG. 5 illustrates a circulating sub that sits on top of the downhole tool, in accordance with embodiments of the present disclosure.

FIG. 5 illustrates a circulating sub 102 that sits on top of the downhole tool 36 and where the flowlines of the downhole well tool 36 connect while the top side is where the completion fluid flow downward to mix both and circulate out. As illustrated, a plurality of mud flows may be enabled by the circulating sub 102 including, but not limited to, mud flow 104 from the coiled tubing pumps at the surface 24, formation fluid flows 106 pumped from a dual packer (e.g., straddled) interval, and mixed fluid flows 108 that is mixed in a mixing chamber 110 and returned to the surface 24 via an annulus formed between the coiled tubing 20 and the wellbore 14. As described in greater detail herein, conveying the downhole well tool 36 and the circulating sub 102 via coiled tubing 20 enables circulation of hydrocarbons in the well while the well is being fully controlled by the coiled tubing pressure control equipment 90 at the surface 24. In general, the circulating sub 102 is the circulation point for mud and formation fluids during transient stations (e.g., the perforation zones 98 illustrated in FIG. 4). In certain embodiments, the circulating sub 102 may provide a mechanical latching mechanism 112 to connect the coiled tubing 20 to the downhole well tool 36. In addition, in certain embodiments, the circulating sub 102 may include dual flapper valves 114 configured to prevent backflow into the drill pipe.

Figure 6:
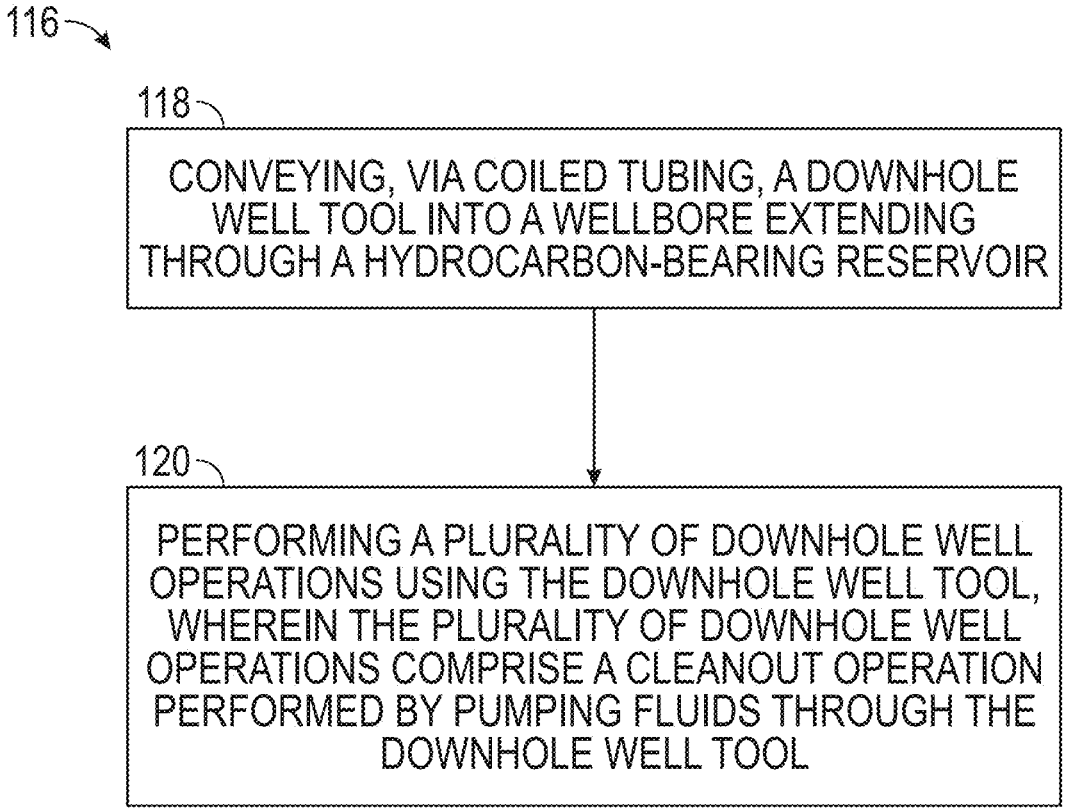
FIG. 6 is a flow diagram of a method for operating the downhole well tool, in accordance with embodiments of the present disclosure.

FIG. 6 is a flow diagram of a method 116 for operating the downhole well tool 36 described herein. As illustrated, in certain embodiments, the method 116 may include conveying, via coiled tubing 20, the downhole well tool 36 into a wellbore 14 extending through a hydrocarbon-bearing reservoir 16 (step 118). In addition, in certain embodiments, the method 116 may include performing a plurality of downhole well operations using the downhole well tool 36, wherein the plurality of downhole well operations include a cleanout operation performed by pumping fluids through the downhole well tool 36 (step 120). In addition, in certain embodiments, the plurality of downhole well operations include a perforation operation performed by perforating the hydrocarbon-bearing reservoir 16 using perforating equipment of the downhole well tool 36. In addition, in certain embodiments, the plurality of downhole well operations include a testing operation performed by testing the hydrocarbon-bearing reservoir 16 using testing equipment of the downhole well tool 36. In addition, in certain embodiments, the method 116 may include performing the plurality of downhole well operations using the downhole well tool 36 while maintaining full well control. In addition, in certain embodiments, the method 116 may include performing the plurality of downhole well operations using the downhole well tool 36 without removing the downhole well tool 36 from the wellbore 14.

In addition, in certain embodiments, the method 116 may include producing hydrocarbons from the hydrocarbon-bearing reservoir 16 while actively circulating fluids through the downhole well tool 36 into an open hole wellbore 14. In addition, in certain embodiments, the method 116 may include producing hydrocarbons from the hydrocarbon-bearing reservoir 16 while actively circulating fluids through the downhole well tool 36 into a cased wellbore 14. In addition, in certain embodiments, the method 116 may include producing hydrocarbons from the hydrocarbon-bearing reservoir 16 without actively circulating fluids through the downhole well tool 36 into an open hole wellbore 14. In addition, in certain embodiments, the method 116 may include producing hydrocarbons from the hydrocarbon-bearing reservoir 16 without actively circulating fluids through the downhole well tool 36 into a cased wellbore 14.

In addition, in certain embodiments, the method 116 may include connecting to the hydrocarbon-bearing reservoir 16 via means of straddled packers 80 for instance, cleaning up the reservoir fluids until getting clean virgin reservoir fluids free of contaminants, performing downhole fluid analysis (e.g., using the downhole well tool 36 and/or the surface processing system 42, as described in greater detail herein), capturing downhole representative samples of the reservoir fluids (e.g., using the downhole well tool 36), measuring pressures and flow rates to conduct a deep transient test (e.g., using the downhole well tool 36), and so forth.

Figure 7:
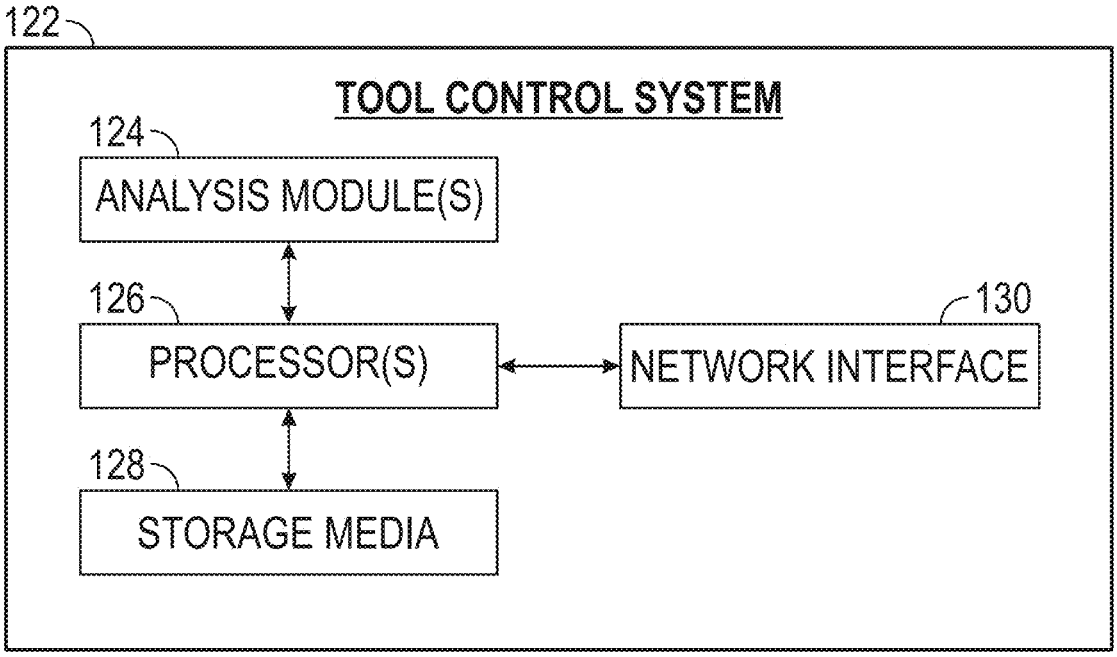
FIG. 7 illustrates an embodiment of a tool control system, in accordance with embodiments of the present disclosure.

As will be appreciated, the analysis described with reference to FIG. 6 may be at least partially performed by the surface processing system 42 described above. However, in other embodiments, the analysis described with reference to FIG. 6 may be performed by a tool control system 122 of the downhole well tool 36. FIG. 7 illustrates an embodiment of the tool control system 122. In certain embodiments, the tool control system 122 may include one or more analysis modules 124 (e.g., a program of processor executable instructions and associated data) that may be configured to perform various functions of the embodiments described herein. In certain embodiments, to perform these various functions, an analysis module 124 executes on one or more processors 126 of the tool control system 122, which may be connected to one or more storage media 128 and a network interface 130 of the tool control system 122. Indeed, in certain embodiments, the one or more analysis modules 124 may be stored in the one or more storage media 128.

In addition, in certain embodiments, the one or more analysis modules 124 of the tool control system 122 may be used in conjunction with the one or more analysis modules 62 of the surface control system 42 to perform various functions of the embodiments described herein. For example, in such embodiments, the one or more analysis modules 124 of the tool control system 122 may provide at least some of the computational functionality described herein, which is also at least partially provided by the one or more analysis modules 62 of the surface control system 42. In other words, the one or more analysis modules 62 of the surface control system 42 and the one or more analysis modules 124 of the tool control system 122 may provide both global and local functionality described herein, respectively. As used herein, the control systems 22, 42 may be collectively referred to as "the control system" in embodiments where they perform certain functions collectively in conjunction with each other.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A method, comprising: conveying, via coiled tubing, a downhole well tool into a wellbore extending through a hydrocarbon-bearing reservoir; and performing a plurality of downhole well operations using the downhole well tool, wherein the plurality of downhole well operations comprise a cleanout operation performed by pumping cleanout fluids through the downhole well tool, wherein the cleanout fluids are mixed with hydrocarbon in a coiled tubing circulation head in the wellbore.

2. The method of claim 1, wherein the plurality of downhole well operations comprise a perforation operation performed by perforating the hydrocarbon-bearing reservoir using perforating equipment of the downhole well tool.

3. The method of claim 1, wherein the plurality of downhole well operations comprise a testing operation performed by testing the hydrocarbon-bearing reservoir using testing equipment of the downhole well tool.

4. The method of claim 1, wherein the plurality of downhole well operations further comprise:

a perforation operation performed by perforating the hydrocarbon-bearing reservoir using perforating equipment of the downhole well tool; and a testing operation performed by testing the hydrocarbon-bearing reservoir using testing equipment of the downhole well tool.

5. The method of claim 1, comprising performing the plurality of downhole well operations using the downhole well tool while maintaining full well control.

6. The method of claim 1, comprising performing the plurality of downhole well operations using the downhole well tool without removing the downhole well tool from the wellbore.

7. The method of claim 1, comprising producing hydrocarbons from the hydrocarbon-bearing reservoir while actively circulating reservoir fluids or the cleanout fluids through the downhole well tool into an open hole wellbore.

8. The method of claim 1, comprising producing hydrocarbons from the hydrocarbon-bearing reservoir while actively circulating reservoir fluids or the cleanout fluids through the downhole well tool into a cased wellbore.

9. The method of claim 1, comprising producing hydrocarbons from the hydrocarbon-bearing reservoir without actively circulating reservoir fluids or the cleanout fluids through the downhole well tool into an open hole wellbore.

10. The method of claim 1, comprising producing hydrocarbons from the hydrocarbon-bearing reservoir without actively circulating reservoir fluids or the cleanout fluids through the downhole well tool into a cased wellbore.

11. The method of claim 1, comprising connecting the downhole well tool to the hydrocarbon-bearing reservoir via straddled packers.

12. The method of claim 1, comprising cleaning reservoir fluids until the reservoir fluids are free of contaminants.

13. The method of claim 1, comprising performing downhole fluid analysis via the downhole well tool.

14. The method of claim 1, comprising capturing downhole samples of reservoir fluids via the downhole well tool.

15. The method of claim 1, comprising measuring pressures and flow rates via the downhole well tool to conduct a deep transient test.

16. The method of claim 15, comprising actively circulating reservoir fluids or the cleanout fluids through the downhole well tool while measuring pressures and flow rates via the downhole well tool to conduct the deep transient test.

17. The method of claim 1, further comprising coupling the downhole well tool to the coiled tubing by way of a circulating sub.

18. The method of claim 17, wherein the circulating sub comprises a mechanical latching mechanism for coupling the downhole well tool to the coiled tubing.

19. The method of claim 17, wherein the circulating sub comprises dual flapper valves configured to prevent backflow.

20. The method of claim 1, wherein the cleanout fluids comprise nitrogen, a cleanout chemical, or a combination thereof.

* * * * *